United States Patent [19]

Byrns

[11] Patent Number: 4,720,021

[45] Date of Patent: Jan. 19, 1988

[54] UTILITY TRAY HAVING FOLDABLE HANDLE

[76] Inventor: James E. Byrns, 1027 2nd Ave., S., Clinton, Iowa 52732

[21] Appl. No.: 800,783

[22] Filed: Nov. 22, 1985

[51] Int. Cl.[4] ..... B65D 25/28

[52] U.S. Cl. ..... 220/94 R; 220/23.8; 220/335; 206/373

[58] Field of Search ..... 220/94 R, 23.8, 22, 220/335; 206/372, 373; 211/65, 66, 60 T

[56] References Cited

U.S. PATENT DOCUMENTS

| | | | |
|---|---|---|---|
| 1,275,695 | 8/1918 | Iverson | 220/94 R |
| 2,458,233 | 1/1949 | Wemyss | 220/94 R |
| 3,191,796 | 6/1965 | Schwartz et al. | 220/23.8 |
| 3,476,282 | 11/1969 | Monaco et al. | 220/23.8 |
| 4,003,611 | 1/1977 | Smith | 220/94 R |
| 4,023,702 | 5/1977 | McKnight | 220/94 R |
| 4,225,052 | 9/1980 | Tector et al. | 220/94 R |

*Primary Examiner*—Joseph Man-Fu Moy
*Attorney, Agent, or Firm*—Thomas J. Greer, Jr.

[57] ABSTRACT

A portable utility tray formed from a resilient thermoplastic material, such as polyethylene. The tray is provided with one or more continuous upward protrusions, of generally inverted V-shape, with one of the protrusions defining a raised rib running centrally and longitudinally of the tray. The top of the rib is provided with sockets to receive pintles carried by a handle pivotally mounted on the rib top, the handle being rotatable over approximately 180°. The handle and rib are provided with cooperating dimple and detent elements to releasably hold the handle in an upright position. The handle may be swung in either of two substantially flat positions, with the handle being releasably held in either of its two extreme, substantially flat positions. The tray is formed by blow molding a preform, to form a double-wall tray, and then cutting off and removing the inner bottom one of double walls.

11 Claims, 5 Drawing Figures

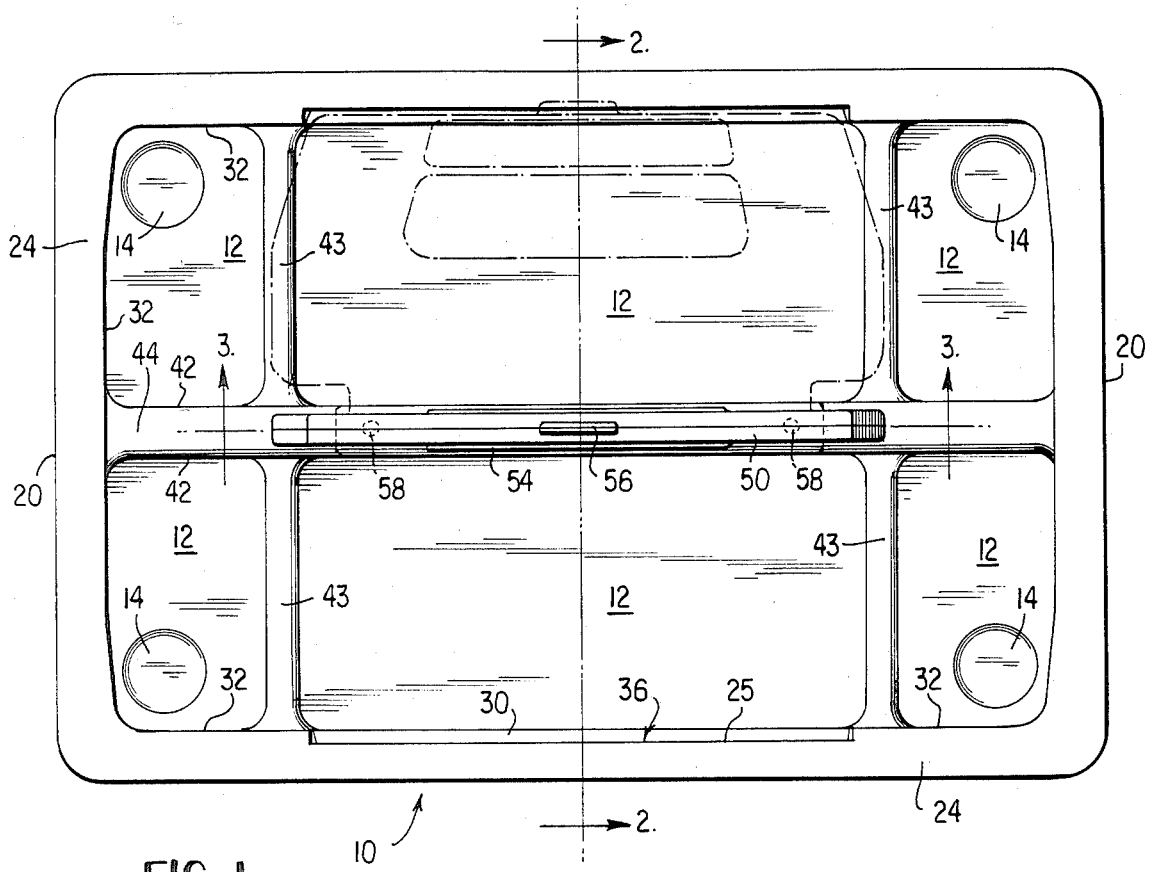
FIG. 1
FIG. 2
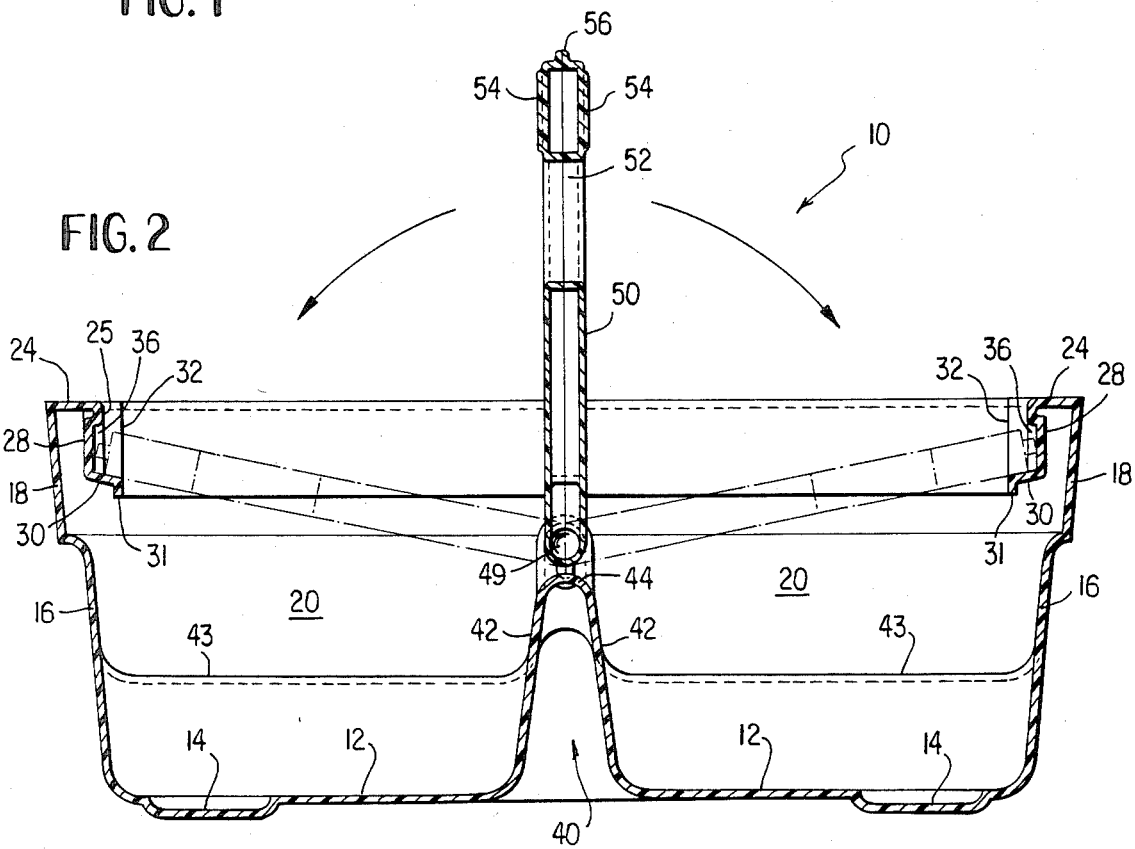

FIG. 3
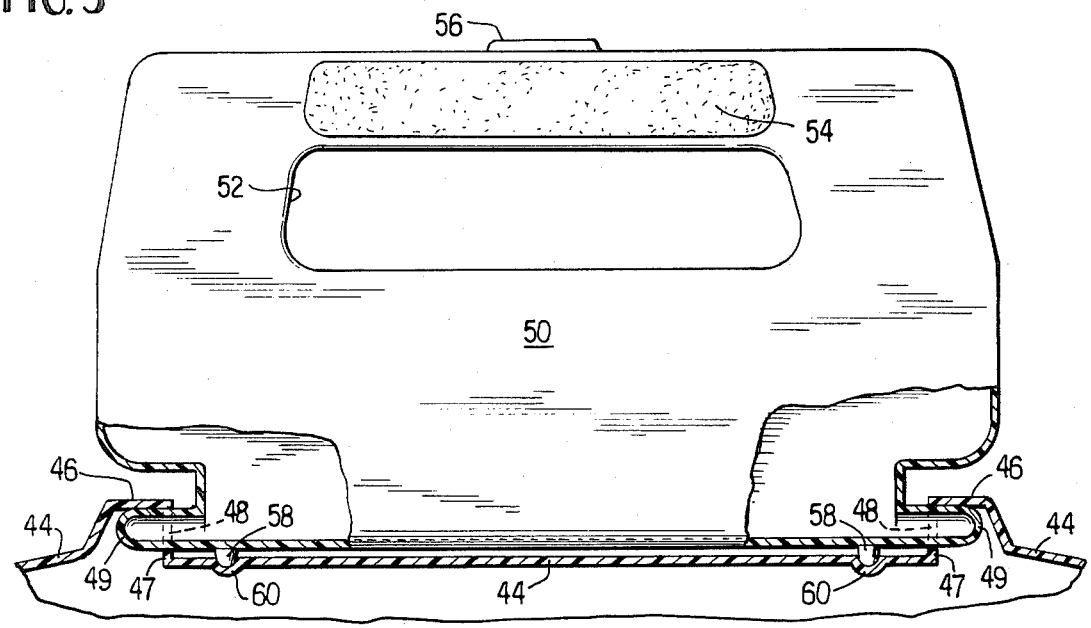
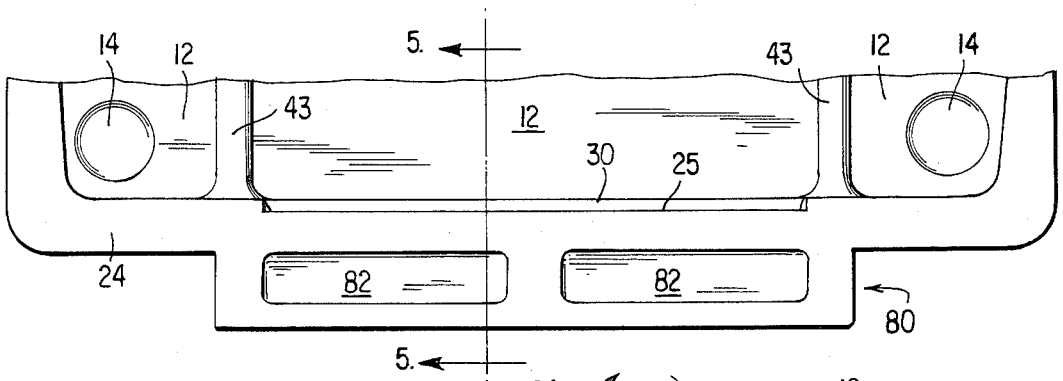
FIG. 4
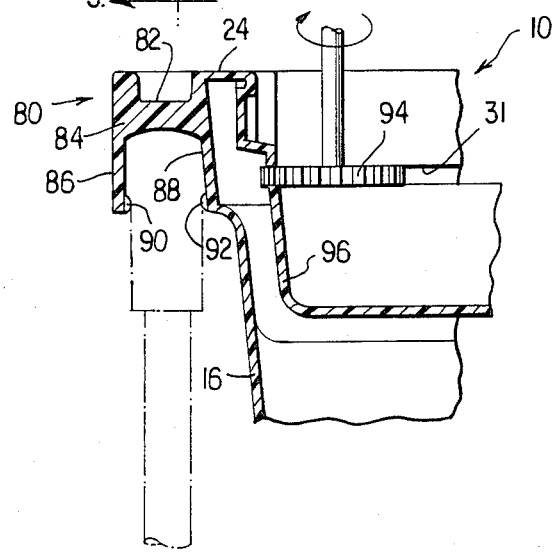
FIG. 5

UTILITY TRAY HAVING FOLDABLE HANDLE

BACKGROUND OF THE INVENTION

This invention relates to a tray and more particularly to a so-called utility tray for holding tools, containers, or the like, the tray being primarily adopted to be used to carry tools to a work station and then after the completion of work to be carried back to its regular or usual storage location.

SUMMARY OF THE INVENTION

According to the practice of this invention a utility tray is provided with a foldable or hingeable handle. The tray construction is such that when the handle is placed in its upright, tray carrying position, it is maintained in that position by means of detent elements. Some sidewise force must be applied, accordingly, to the handle to swing the handle away from its upright position. Further according to the practice of this invention the tray construction is such that when the handle is rotated to either one of two substantially horizontal positions it is releasably maintained in that position by virtue of the resilient nature of the handle and of the configuration of oppositely facing recesses which receive the handle in, respectively, its two substantially horizontal positions. Further according to the practice of this invention the handle is provided with integrally formed feet, the construction being such that with the handle being folded down in either of its two substantially horizontal positions, the feet snuggly engage the corners of a lower, next adjacent tray, to thereby permit stacking of the trays. Further according to the practice of this invention, the bottom of the tray is provided with at least one divider rib, these divider ribs being integrally formed with the bottom of the tray, to thereby divide the tray into two or more compartments.

BRIEF DESCRIPTION OF THE DRAWINGS

FIG. 1 is a plan view of the tray of this invention.

FIG. 2 is a view taken along section 2—2 of FIG. 1, FIG. 2 further illustrating the method of formation of the tray.

FIG. 3 is a view taken along section 3—3 of FIG. 1.

FIG. 4 is a partial top plan view, similar to FIG. 1, of a second embodiment of the invention.

FIG. 5 is a view taken along section 5—5 of FIG. 4.

Referring now to the drawings, the numeral 10 denotes generally the tray of this invention, the tray having a bottom wall 12 which carries, at its four corners, downwardly depending feet 14. The numeral 16 denotes generally upwardly extending side walls of the tray, the walls extending completely around the four sides of the tray. The numeral 18 denotes upward extensions of walls 17, continuous upper wall portion 18 terminating in horizontal and inwardly extending ledge 14. The numeral 20 denotes the end walls of the tray, the tray being generally rectangular as shown at FIG. 1. The numeral 25 denotes an overhang at the radially innermost portion of horizontal flange 24, overhang 25 extending downwardly for a short distance and then radially outwardly and then extending substantially vertically downwardly to define portion 28. Portion 28 terminates in substantially horizontal extending portion 30, with the numeral 31 denoting the lowermost rim of portion 30, portion 31 extending downwardly. The numeral 32 denotes a continuous and substantially vertically extending wall, also downwardly depending from horizontal flange 24. Those portions of wall 32 which are provided with wall portions 28 and 30 define a pair of oppositely facing recesses 36. Thus, there is one recess 36 for each of the two longitudinal side walls of the tray, each recess 36 being, in general, of lesser length than walls 32 along the sides of the tray.

The numeral 40 denotes an upwardly extending recess in the bottom of the tray, the recess defined by upwardly extending and integral wall portions 42 meeting at upper ridge portion 44. The walls 42 define a generally inverted V-shape rib extending from one end wall to the other end wall, as may be seen by reference to FIG. 1. If desired, other similarly inverted V-shape rib elements may be provided spanning and running across the bottom of the tray, such as transverse ribs 43 of FIG. 1. It will be understood that the number and location of such transversely extending ribs (parallel to the ends of the tray) may be varied in accordance with the intended use of the tray. The tray is formed from a resilient thermoplastic material such as polyethylene.

FIG. 3 indicates the detent and hinge construction of the tray, with ridge portion 44 of rib 40 being provided with a raised portion 46 and a downwardly extending portion 47 which then continues across the middle of the tray to a similarly configured construction at the other end of the handle (now to be described). Wall portion 47 is provided with an aperture 48 for receiving pintle 49 of handle 50. The numeral 52 denotes the aperture in handle 50, both upper surfaces of handle 50 being provided with roughed portions 54 to facilitate gripping. The topmost portion of the handle is provided with a protrusion 56 in the form of an elongated rib. The lower portion of the handle 50 is provided with integral nodules 58 which fit into complementary recesses 60 of ridge portion 44 of rib 40. From a consideration of both FIGS. 2 and 3, it will be seen that handle 50 is formed by mating together two substantially planar portions.

From a consideration of FIG. 2, it will be seen that handle 50 may be swung to a substantially horizontal position, in either direction, so as to become engaged in either of recesses 36. Swinging of handle 50 from the vertical position shown at FIG. 2 is possible by the resiliency of the thermoplastic, this resiliency permitting nodules 58 to be swung away from complementary recesses 60. As handle 50 is swung from the vertical position to either of the two substantially horizontal positions, protrusion 56 abuts overhand portion 25 (see FIG. 2) so that the top portion of handle 50 is received in either of recesses 36. The handle is thus releasably held in either of these two substantially horizontal positions, this permitting the handle to serve the dual function of a hold-down piece of the tray such as to, in some conditions of use, prevent wind from blowing rags and other light objects away from the tray. To swing the handle back to the vertical position, it is necessary to pull the handle so that protuberance 56 overcomes the resiliency of overhang portion 25.

Referring now to FIGS. 4 and 5 of the drawings, a modification is shown which exhibits utility in adapting the tray for use as an auxiliary support for items usually associated with a baby crib or the like. The numeral 80 denotes an integral clamp addition to one of the two longitudinal sides of the tray, the tray being otherwise of the construction illustrated at FIGS. 1-3. The numeral 82 denotes any one of two recesses in clamp 80, with numeral 84 denoting the central or bight portion of the clamp, the clamp having leg portions 86 and 88 and thus being in the general form of an inverted U. The numerals 90 and 92 denote oppositely facing nodules which are placed on the inner portions of their respective legs 86 and 88. In use, the tray 10 is clamped onto the upper portion of the usual horizontal side railing of a baby crib, with nodules 90 and 92 engaging overhang portions of the baby crib runner. In this use of the invention, the tray functions as an auxiliary tray to a baby crib, for the purpose of holding bottles, nipples, and other articles associated with baby cribs.

Referring now to FIGS. 2 and 3 of the drawings, an explanation of the manner of assembling the tray and handle will be given. Referring now to FIG. 3, the handle is assembled onto the tray by inserting the pintles 49 into corresponding and opposing apertures 48 while the tray is still hot or warm as taken from the molding die. The handle 50 is flexed along an axis generally transverse to its longitudinal axis, i.e., about a vertical axis as viewed at FIG. 3, so as to shorten somewhat the distance between opposing pintles 49. With the pintles 49 now being forced into openings 48, the cooling of the tray results in a slight contraction and subsequent lessening of the distance between opposing apertures 48 of ridge 44, thereby securing the handle to the tray.

The manner of making the tray of this invention is indicated in FIG. 5. The tray is originally formed by blow molding a preform, in a manner well known in the thermoplastic molding art, to form a double-wall tray one bottom wall of which is bottom 12 previously described and the other bottom wall and a portion the latter's side wall, which are removed, denoted by 96. After this blow molding step, a rotating router blade 94 is inserted into the interior of the doublewall tray, as indicated in FIG. 5 and is moved so as to cut away the upper portion of the interior bottom tray wall 96. The lowermost interior rim of the remaining portion of the tray is denoted by the numeral 31. Blow molding of a preform, resulting in a double-wall tray, makes it possible to form the irregular cross-sectional shape of portions 25 and 28 of recesses 30 on both sides of the tray. Because of the irregular form of recesses 30, vacuum forming or other thermoforming processes could not as easily yield the desired shape.

What is claimed is:

1. A portable and generally rectangular utility tray formed from a resilient thermoplastic material, the tray having bottom and side walls and having an open top, an integral, longitudinally and upwardly extending raised central rib reunning from one end wall to the opposite end wall, to thereby divide the tray interior, the upwardly extending rib being substantially V shaped in inverted transverse cross-section and being formed from the bottom wall of the tray and forming an integral portion of the bottom wall, the upper portion of the upwardly extending rib carrying a hinged handle, the lower portion of the handle being hingedly mounted on the top edge of the upwardly extending central rib, the handle being mounted for swinging movement from a first angular position wherein the upper end of the handle engages and is releasably retained by a portion of one sidewall of the tray to a second angular position wherein the upper end of handle engages and is retained by a portion of the sidewall of the tray which is opposite to said first mentioned tray sidewall, said handle carrying means to releasably maintain it in an upright position, said means being defined by at least one pintle integral with a lower portion of the handle and by a corresponding and aligned depression on the upper portion of the centrally running rib, the pintle fitting into the depression when the handle is in its upright position, the resiliency of the plastic material permitting the handle to be swung away from its upright position.

2. The tray of claim 1 wherein at least a portion of those two opposite sidewalls of the tray parallel to said raised rib are each provided with a recess having an overhang portion, and wherein the top of the handle releasably fits into each said recess when the handle is swung to either of said two angular positions, the radius of the handle top measured from its hinge axis being slightly greater than the distance from the hinge axis of the handle to said overhang portion of each recess, the resiliency the plastic material permitting the handle top to engage and then to pass by the overhang portion of a respective recess and to thereby releasably maintain the handle top in that respective recess, the resiliency of the plastic material permitting the handle top to engage and then to pass by the overhang portion when swung towards its vertical position from its position in the recess.

3. The tray of claim 2 wherein the top of the handle is provided with an upwardly extending protrusion, the protrusion being that part of the handle which engages and passes said overhang portions.

4. The tray of claim 1 wherein the handle is hollow and is defined by two mating, generally planar halves.

5. The tray of claim 1 wherein an outer portion of one of the tray sidewalls is provided with an integral clamp which extends laterally and outside of that one tray sidewall, the clamp running parallel to that one tray sidewall and being generally inverted-U shaped in transverse cross-section thereof, at least one end of one leg of the U shape carrying a nodule, the nodule facing towards the opposite leg of the U shape, whereby the tray is attachable to a horizontally extending rail, such as one of the upper, horizontally extending rails of a baby crib.

6. The tray of claim 5 wherein the innermost one of the two legs of the U shape, as referred to the interior of the tray, coincides with a portion of that tray sidewall which carries said integral clamp.

7. The tray of claim 2 wherein the upper edges of the tray sidewalls are provided with an integral, inwardly extending and substantially horizontal and continuous edge flange, the radialy innermost portion of the flange integrally connected to a downwardly extending inner wall which is also continuous and which follows the upper edge periphery of the tray.

8. The tray of claim 7 wherein said handle top receiving recesses in the said two opposite sidewalls are formed in said downwardly extending inner wall.

9. The tray of claim 7 wherein the bottom of the tray is provided with feet adjacent its corners, the relationship between the location of the feet on the tray bottom and the radially inward extent of the substantially horizontal edge flange are such that, with the handle top swung down and its top positioned in one of the recesses, a portion of each foot of an upper, stacked tray engages a portion of the radially innermost portion of the horizontal flange of a lower, next adjacent stacked tray.

10. The tray of claim 1 wherein the vertical extent of said upwardly extending central rib is less than the vertical extent of said side walls.

11. The tray of claim 1 including an upwardly extending, raised and transverse rib, running at right angles to and intersecting said raised central rib and being of inverted V-shape in transverse cross section and extending from one tray side wall to the other tray side wall.

* * * * *